US010307928B2

(12) United States Patent
Chergui et al.

(10) Patent No.: US 10,307,928 B2
(45) Date of Patent: Jun. 4, 2019

(54) DEVICE FOR PUNCHING AN OPENING INTO A LIGHTWEIGHT METAL SHEET AND A METHOD FOR PERFORMING THE SAME

(71) Applicants: THYSSENKRUPP STEEL EUROPE AG, Duisburg (DE); THYSSENKRUPP AG, Essen (DE)

(72) Inventors: Azeddine Chergui, Dortmund (DE); Andreas Niesen, Klausen (DE)

(73) Assignees: THYSSENKRUPP AG, Essen (DE); THYSSENKRUPP STEEL EUROPE AG, Duisburg (DE)

( * ) Notice: Subject to any disclaimer, the term of this patent is extended or adjusted under 35 U.S.C. 154(b) by 481 days.

(21) Appl. No.: 14/682,598

(22) Filed: Apr. 9, 2015

(65) Prior Publication Data

US 2015/0290695 A1 Oct. 15, 2015

(30) Foreign Application Priority Data

Apr. 9, 2014 (DE) ..... 10 2014 105 056

(51) Int. Cl.

| | |
|---|---|
| ***B26D 7/10*** | (2006.01) |
| ***B21D 28/26*** | (2006.01) |
| ***B26D 7/18*** | (2006.01) |

(52) U.S. Cl.

CPC ..... *B26D 7/10* (2013.01); *B21D 28/26* (2013.01); *B21D 28/265* (2013.01); *B26D 7/1863* (2013.01)

(58) Field of Classification Search

CPC ..... B21D 28/265; B21D 28/26; B26D 7/10; B26D 7/1863; Y10T 83/0414; Y10T 83/0405; Y10T 83/041; Y10S 83/956

See application file for complete search history.

(56) References Cited

U.S. PATENT DOCUMENTS 2,122,368 A * 6/1938 Engler ..... B26F 1/44 219/227
3,183,339 A * 5/1965 Lins ..... B26F 3/06 219/383
4,304,747 A 12/1981 Lake
(Continued)

FOREIGN PATENT DOCUMENTS

CN 201325088 Y 10/2009
DE 60003497 T 5/2004
(Continued)

OTHER PUBLICATIONS

English abstract for DE102012109046A.
(Continued)

*Primary Examiner* — Phong H Nguyen
(74) *Attorney, Agent, or Firm* — Lathrop Gage L.L.P.

(57) ABSTRACT

The present invention proposes a device, robot with such a device, punch for such a device and method for punching an opening into a lightweight metal sheet that has at least two metallic outer layers and at least one non-metallic core layer arranged between the metallic outer layers, the device having means for carrying out a relative movement of a punch with respect to the lightweight metal sheet and a quill with an integrated heat source, the punch being able to be heated up by the heat source.

14 Claims, 2 Drawing Sheets

(56) References Cited

U.S. PATENT DOCUMENTS

| | | | | |
|---|---|---|---|---|
| 4,767,482 | A * | 8/1988 | Diez | B29C 65/18 156/163 |
| 5,377,415 | A * | 1/1995 | Gibson | B26D 5/18 30/358 |
| 6,294,751 | B1 | 9/2001 | Gall | |
| 2003/0231418 | A1* | 12/2003 | Katsuda | B26F 1/36 360/55 |

FOREIGN PATENT DOCUMENTS

| | | | |
|---|---|---|---|
| DE | 102012109046 | A | 4/2014 |
| GB | 1121627 | A | 7/1968 |
| JP | 61014027 | A | 1/1986 |
| JP | H07171637 | A | 7/1995 |
| JP | 11031774 | A | 2/1999 |

OTHER PUBLICATIONS

English abstract for JPH07171637A.
Chinese Application No. 2015101647386, First Search, dated Jan. 9, 2016, one page.

* cited by examiner

DEVICE FOR PUNCHING AN OPENING INTO A LIGHTWEIGHT METAL SHEET AND A METHOD FOR PERFORMING THE SAME

CROSS-REFERENCE TO RELATED APPLICATIONS

This application claims foreign priority to German patent application serial no. DE 102014105056.8, filed Apr. 9, 2014, the entire contents of which is hereby incorporated by reference herein.

FIELD

This disclosure relates to a device for punching an opening into a lightweight metal sheet, a robot with such a device, a punch for such a device and a method for punching an opening into a lightweight metal sheet.

BACKGROUND

Lightweight metal sheets are known from the prior art and preferably comprise at least two metallic outer layers, between which at least one nonmetallic core layer is arranged. In spite of their low weight, such lightweight metal sheets have high local stiffness and are able to provide effective sound damping. Many applications require that these lightweight metal sheets can be connected to other sheet-metal parts or components. However, the joining methods that are often used for metal sheets, such as fusion welding or soldering, cause problems on account of their high heat input. The reason for this is that a thermoplastic material is preferably used as the plastic for the core layer, which has the effect that the core layer produced from this plastic melts during joining, or is damaged in some other way.

It is therefore advantageous for connecting a lightweight metal sheet to another component to provide a frictionally engaging and/or interlocking connection via an opening in the lightweight metal sheet by using a connecting element, such as a screw or a rivet. On account of the flow behaviour of the non-metallic core layer, preferably consisting of plastic, this cannot however ensure lasting strength of the connection. One cause for this can be seen in a decreasing holding force over time, on account of the flow behaviour. As a consequence, the connection between the lightweight metal sheet and the component, for example a metal sheet, loosens.

SUMMARY

An object of the present invention is to provide a device for punching an opening into a lightweight metal sheet, a robot with such a device, a punch for such a device and a method whereby an opening can be punched into a lightweight metal sheet effectively. In one aspect of the present disclosure, it is possible for a part of a core layer of the lightweight metal sheet in a peripheral region of the opening to be removed, and subsequently, the outer layers of the lightweight metal sheet may be brought into contact with each other in the peripheral region of the opening. It is also intended at the same time that different openings can be flexibly provided in a wide variety of lightweight metal sheets.

In one aspect of the present disclosure, a device for punching an opening into a lightweight metal sheet having at least two metallic outer layers and at least one non-metallic inner core layer disposed between the metallic outer layers, is disclosed. In one embodiment, such a device includes a quill having a heat source integrated therewith, a punch coupled to the quill and configured to be heated by said heat source, and a means for moving the punch in a first direction relative to the lightweight metal sheet. The quill, punch, and means for moving the punch form a punching device.

BRIEF DESCRIPTION OF THE DRAWINGS

The present invention is described in detail below with reference to the attached drawing figures, wherein.

DETAILED DESCRIPTION

Figure 1:
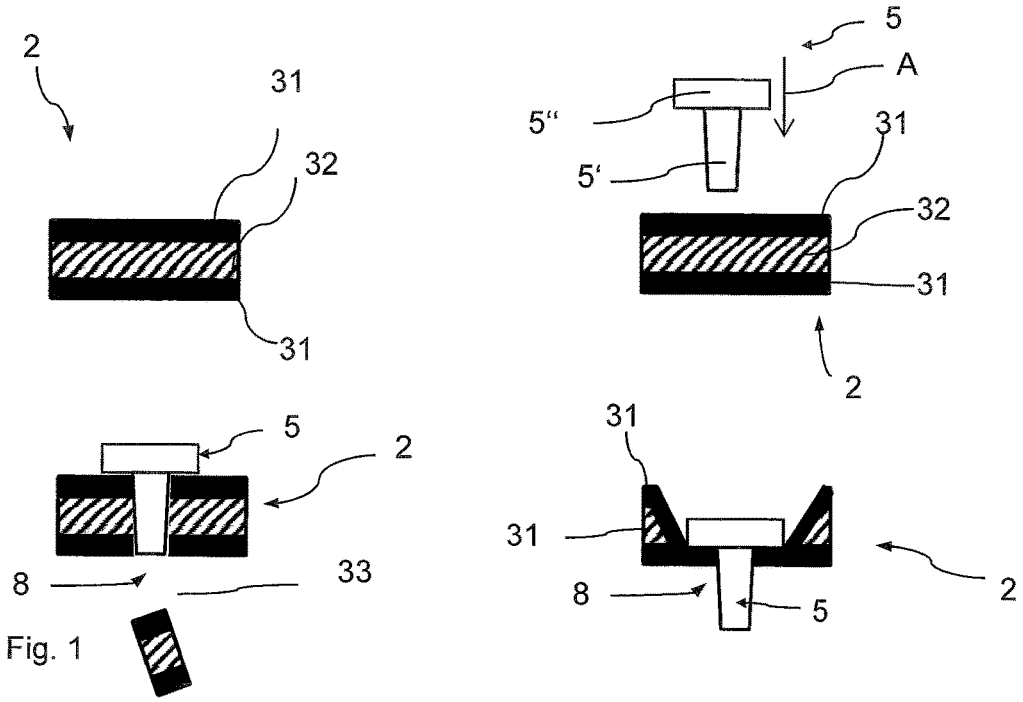
FIG. 1 is a series of partial cross section views through a lightweight metal sheet depicting steps of an embodiment of a method of the present disclosure for punching an opening into the lightweight metal sheet.

Disclosed herein is a device for punching an opening into a lightweight metal sheet, a robot with such a device, a punch for such a device, and a method for punching an opening into a lightweight metal sheet that has at least two metallic outer layers and at least one non-metallic core layer disposed between the metallic outer layers. The punching device is configured to move a punch with respect to the lightweight metal sheet and includes a quill with an integrated heat source, wherein the punch may be heated up by the heat source.

A device as presently disclosed herein has the advantage of a heat source that can indirectly or directly control the thermal state of the punch, which according to a preferred embodiment is exchangeable, and which for this purpose is integrated in the quill. The thermal energy taken up by the punch is essential here for removing and/or deforming the non-metallic core layer in a peripheral region of the punched opening. By removing or deforming the non-metallic core layer and establishing electrical contact, it is possible to provide an opening in the lightweight metal sheet that is particularly well-suited for a durable connection between the lightweight metal sheet and another component by a connecting element, such as for example a screw or rivet. The thermal energy is in this case preferably adapted to the melting temperature of the non-metallic core layer. Furthermore, the punches mounted on the quill can be exchanged, which makes the device particularly flexible for punching a wide variety of openings into different lightweight metal sheets. For this purpose, a range of punches is provided, from which the desired punch can be chosen.

The non-metallic core layer preferably comprises a thermoplastic material, to which the capacity of the heat source is adapted. It is also conceivable that the heat source is designed in such a way that a heat output emanating from it is controllable. For this purpose, the heat source comprises for example a heating pin, the heat output of which can be controlled by way of an electric current. As a result, the heat output can be set such that the required thermal energy is transferred to the punch. With a controllable heat source, it could also be ensured that the punch changes its temperature during and/or after the punching of the opening, in order then to have in certain intervals the thermal energy required for removing and/or deforming the non-metallic core layer. In particular, it is provided that the punch is mounted on the quill in such a way that thermal energy can be transferred directly or indirectly from the heat source to the punch. It is also conceivable that the lightweight metal sheet already has an opening, and the device is used for at least partially removing and/or deforming the non-metallic core layer in the peripheral region of the opening and subsequently bringing the outer layers into contact. It is also provided that the relative movement takes place along a direction running parallel to the axis of the quill.

In a further embodiment it is provided that the heat source is at least partially arranged within the quill. In particular, the quill comprises a hollow body serving as a receptacle, in which the heat source is received. As a consequence of this, the heat source can be placed as close as possible to the punch, whereby the thermal energy emanating from the heat source has to cover a smaller distance. It is consequently possible for the thermal energy in the punch to be kept under control quickly and as far as possible without any losses by way of the heat source.

In a further embodiment it is provided that the quill has auxiliary means for arresting the punch on the quill. In particular, the auxiliary means are designed in such a way that they allow secure fixing of the punch to the quill with complementary auxiliary means on the punch. For example, a system made up of auxiliary means and complementary auxiliary means comprises interlocking and/or frictionally engaging means, which fix the punch releasably to the quill. In particular, the auxiliary means and the complementary auxiliary means snap and/or engage in one another when the punch is pulled onto the quill. It is also conceivable that the system made up of auxiliary means and complementary auxiliary means is designed in such a way that it contributes to aligning or orienting the punch. In particular, the quill only has the auxiliary means in one region along its circumference. In order to fix the punch successfully on the quill, the punch must then be aligned in such a way that the complementary auxiliary means can enter into an effective connection after the pulling on of the punch.

In a further embodiment it is provided that the quill has a conical or frustoconical neck for an interlocking connection between the quill and the punch. In particular, a conical or frustoconical neck is arranged at one end of the quill. The end of the quill then forms a receiving region for the punch, by way of which the punch is pulled on in an easy and uncomplicated way. The neck thereby preferably engages in the punch. The design as a conical or frustoconical neck even allows the punch to be offset a little in relation to the axis of the quill when it is being pulled on, to then be centred or aligned as it is being pulled on. As a result, the pulling on is advantageously made easier.

In a further embodiment it is provided that the punch has a punching region and a stamping region, the stamping region at least partially surrounding the punching region in a peripheral manner. It is provided in this respect that the punching region punches the opening into the lightweight metal sheet and the stamping region is responsible for bringing the respective outer layers into contact with each other. It is also conceivable that different thermal energies are provided for the stamping region and the punching region. It can correspondingly be envisaged that the stamping region and the punching region are made from different materials with different thermal conductivities, which allow the punching region and the stamping region to be at different temperatures.

In a further embodiment it is provided that the stamping region is offset from the punching region. An offset makes it possible to provide a punch which, in its relative movement with respect to the lightweight metal sheet, first punches the opening by the punching region and subsequently, as the relative movement continues, brings the outer layers into contact by the stamping region.

In a further embodiment it is provided that the device has a flat matrix for supporting the lightweight metal sheet, the flat matrix being arranged opposite the quill in the direction of the relative movement. In particular, the flat matrix acts as an abutment for the lightweight metal sheet when the opening is being punched. Use of the flat matrix as an abutment advantageously means that a punch imprint is only visible on one side.

In a further embodiment it is provided that the flat matrix has a suction-extraction opening for extracting a part of the core layer that is displaced during the punching. It is preferably provided in this respect that the suction-extraction opening is arranged in the device opposite the quill with the mounted punch. The suction-extraction opening is used in particular for extracting the displaced part of the core layer in the case of pre-punched lightweight metal sheets. The suction extraction means that the displaced part is advantageously removed cleanly, whereby unwanted soiling of the lightweight metal sheet with the displaced part of the core layer is prevented.

In a further embodiment it is provided that the device has a gripper, on the first gripper jaw of which the quill is arranged and on the second gripper jaw of which the flat matrix for mounting the lightweight metal sheet is arranged. The gripper has in particular a gripper opening for receiving the lightweight metal sheet between the two gripper jaws. It can be envisaged in this respect that the gripper is designed in such a way that its gripper opening changes, and can consequently be adapted to a thickness of the lightweight metal sheet. It is also provided that the relative movement for the punching of the opening is brought about by the moving together of the gripper jaws. For this purpose, the flat matrix and the quill are arranged opposite one another in the gripper.

In a further embodiment it is provided that the first gripper jaw is manually or automatically movable in relation to the second gripper jaw by way of a lever means. A manually operated device is particularly advantageously suitable for mobile use. In the case of an automatically operated lever means, the device is preferably attached to a robot, in particular to a robot arm. The moving together of the gripper jaws is preferably kept under control in a motor-controlled manner by way of a drive. As a result, a movement that can be particularly kept under control can be obtained during the punching of the opening.

In a further embodiment it is provided that the quill can be exchangeably mounted on the first gripper jaw by way of a sleeve. By exchanging the quill, the range of the possible gripper opening can be changed, if for example a different quill of a different length is inserted into the device. Furthermore, the quill can be easily taken out of the device and exchanged in the event of defects or other complications.

In a further embodiment it is provided that the device is arranged on a robot, by which the device can be transferred to a changing table for a punch change, it being possible that the quill with the punch can be moved on the changing table up to a stop in such a way that the punch is released from the quill. It is also provided that the device, controlled by the robot, can be moved to another punch and pulls this punch onto the quill by an axial compressive force. With the aid of the auxiliary means, the punch can then also be fixed in such a way that the device can be used for punching the opening. In such an embodiment, the punch can be advantageously changed fully automatically, which makes it particularly suitable for production lines on which lightweight metal sheets are used.

A further subject of the present invention is a robot with a device such as that described above. Such a robot may be integrated in a production line on which lightweight metal sheets are processed. The uncomplicated fully automatic changing of the punches allows the robot to be used for punching a wide variety of openings into different lightweight metal sheets.

A further subject of the present invention is a punch for a device such as that described above. In particular, the punch is adapted to the device and can only be pulled on when the punch and the device have been made to match one another on the basis of a lock-and-key principle. It is also conceivable that the punch is part of a range of punches. The punches of the range of punches preferably differ in the geometry of the punches, the number of openings that can be made with the punch, and/or the design of the punching region and the stamping region.

A further subject of the present disclosure is a method for punching an opening into a lightweight metal sheet by a device as disclosed herein. Using the device described above advantageously allows the making of openings that allow a durable, i.e. long-term, connection between the lightweight metal sheet and another component.

In an embodiment of the method it is provided that in a first method step the opening is punched by the relative movement of the punch with respect to the lightweight metal sheet, in a second method step the non-metallic core layer being at least partially displaced by the thermal energy taken up from the heat source and in a third method step the metallic outer layers being brought into contact in a region adjacent to the opening. It is also provided that the punch is changed at a time before the first method step and/or at a time after the third method step, preferably fully automatically. For this purpose, the device is preferably moved onto a changing table with a stop. The punch is pushed out with the aid of the stop. It is also provided that, for the punch change, the device is moved in such a way that an interlocking engagement with the quill is brought about for another punch, by a compressive force acting axially on it, with the effect that the punch is firmly connected to the quill without any further effort.

Further details, features and advantages of the invention emerge from the drawings, and also from the following description of various embodiments with reference to the attached drawing figures. The drawings thereby merely illustrate exemplary embodiments of the invention that do not restrict the scope of the concept of the invention.

In the various drawing figures, the same parts are always provided with the same designations, and are therefore in each case also generally only referred to or mentioned once.

Referring to FIG. 1, a method for punching an opening 8 into a lightweight metal sheet 2 as provided by the present invention is disclosed. Lightweight metal sheets 2 preferably comprise at least two metallic outer layers 31, between which at least one non-metallic core layer 32 is disposed. In spite of their low weight, such lightweight metal sheets 2 have high local stiffness and are able to provide effective sound damping. Many applications require that these lightweight metal sheets 2 can be connected to other sheet-metal parts or components. However, the joining methods that are often used for metal sheets, such as fusion welding or soldering, often cause problems on account of their high heat input. The reason for this is that a thermoplastic material is preferably used as the plastic for the core layer, which has the effect that the core layer 32 produced from this plastic melts during joining, or is damaged in some other way. It is therefore advantageous for connecting a lightweight metal sheet 2 to another component to provide a frictionally engaging and/or interlocking connection via an opening 8 in the lightweight metal sheet 2 by using a connecting element, such as a screw or a rivet. On account of the flow behaviour of the non-metallic core layer 32, preferably consisting of plastic, this cannot however ensure lasting strength of the connection. One cause for this can be seen in a decreasing holding force over time, on account of the flow behaviour. As a consequence, the connection between the lightweight metal sheet 2 and the component, for example a metal sheet, loosens.

In order to counter this problem, preferably in a peripheral region around the opening 8 that is intended for the frictionally engaging and/or interlocking connection, the non-metallic core layer 32 between at least two metallic outer layers 31 is removed and contact between these outer layers 31 is established. With such contact, a durable frictionally engaging and/or interlocking connection can be provided. FIG. 1 shows a method in which an opening 8 is punched into a lightweight metal sheet 2 by a punch 5 with a punching region 5' and a stamping region 5" being moved in relation to the lightweight metal sheet 2. The relative movement has the effect that first a part 33 is first pushed out from the lightweight metal sheet 2 with the aid of the punching region 5', in order to form the opening. It is also provided that the punch 5 has so much surplus thermal energy that the peripheral region of the opening created is heated up and deformed during and/or after the punching of the lightweight metal sheet 2 in such a way that the non-metallic core layer 32 is at least partially displaced along the circumference of the opening. In particular, the relative movement of the punch 5 is continued in such a way that the stamping region 5" of the punch 5 ensures that the outer layers 31 are brought into contact with one another.

Figure 2:
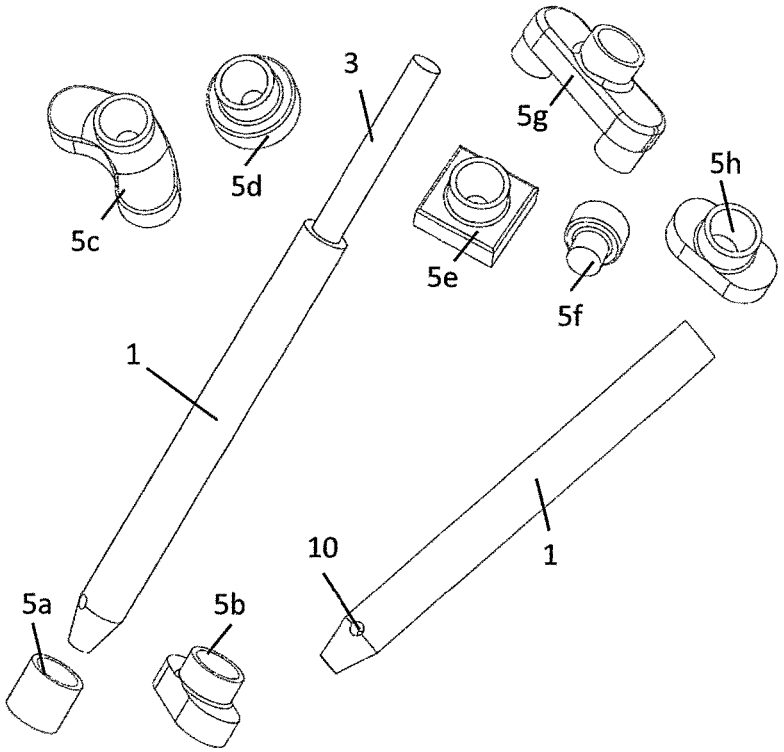
FIG. 2 is an isometric view of an embodiment of a quill and a range of punches for a device as disclosed herein for punching an opening into a lightweight metal sheet.

Referring to FIG. 2, a quill 1 with a range of punches **5*a*-5*h* for a device 100 for punching an opening 8 according to a first exemplary embodiment of the present disclosure is shown. It is in this case provided that the quill 1 is designed in such a way that it can receive or integrate a heat source 3. In particular, it is provided that the quill 1 has a hollow space in which the heat source 3 is at least partially arranged. For example, the quill 1 encloses the heat source 3. It is conceivable in this respect that the heat source 3 is a heating pin, the thermal capacity of which is electrically controllable and is adapted to the temperature that is optimal for the respective punching process. It is also provided that the punch 5, which is intended for forming the opening 8 and removing or deforming a part of the non-metallic core layer 31, can be exchangeably mounted on the quill 1. In the representation of FIG. 2, the punch 5 is illustrated as detached from the quill 1. It is provided in particular in this respect that there is the possibility of selecting the desired punch 5 from the range of punches 5*a*-5*h* and attaching it to the quill 1. For example, it is possible to choose between punches 5 that make different openings 8 or in each case make a multiplicity of openings 8. It is also conceivable that it is possible to choose between punches 5 of different sizes, in order to adapt the punch 5 to the thickness of the lightweight metal sheet 2. Furthermore, the punch 5 may be formed in such a way that different openings 8 can be made in the lightweight metal sheet 2** in a desired or intended arrangement.

For the mounting of the punch 5 on the quill 1, the latter has at its one end a conical neck for an interlocking connection with the punch 5. The conical shape advantageously helps when the punch 5 is being pulled onto the quill 1. It is also provided that the quill 1 has an auxiliary means 10 for arresting the punch 5. The auxiliary means 10 may thereby help to fix the punch 5 appropriately for its use. Furthermore, the auxiliary means 10 may align the punch 5 in an orientation that is preferred for the punching, if for example the punch 5 is asymmetrical in its basic shape. In particular, it can be envisaged that the punch 5 engages or snaps into the auxiliary means while it is being pulled onto the quill 1. The punch preferably comprises an auxiliary means that is complementary to the auxiliary means 10 and with which the auxiliary means 10 fixes the punch on the quill. It is also conceivable that the auxiliary means 10 and/or the complementary auxiliary means have a spring element.

Irrespective of in what way the punch 5 is mounted or fixed on the quill 1, it is provided in particular that the mounted punch 5 indirectly or directly takes up the heat emanating from the heat source 3, in order to itself be able to provide the thermal energy necessary for the removal or deforming of a part of the non-metallic core layer 32, and transfer it to the lightweight metal sheet 2. In this respect, the punch 5 may be designed in such a way that the stamping region 5" and the punching region 5' of the punch 5 can take up or store different amounts of thermal energy. For example, the punch 5 is of a multicomponent type of construction, the individual material components having different thermal conductivities, which ensure that the stamping region 5" and the punching region 5' assume different temperatures or take up different amounts of thermal energy from the heat source 3. As a result, the punching can be flexibly adapted to the opening 8 to be respectively made in the lightweight metal sheet 2.

Figure 3:
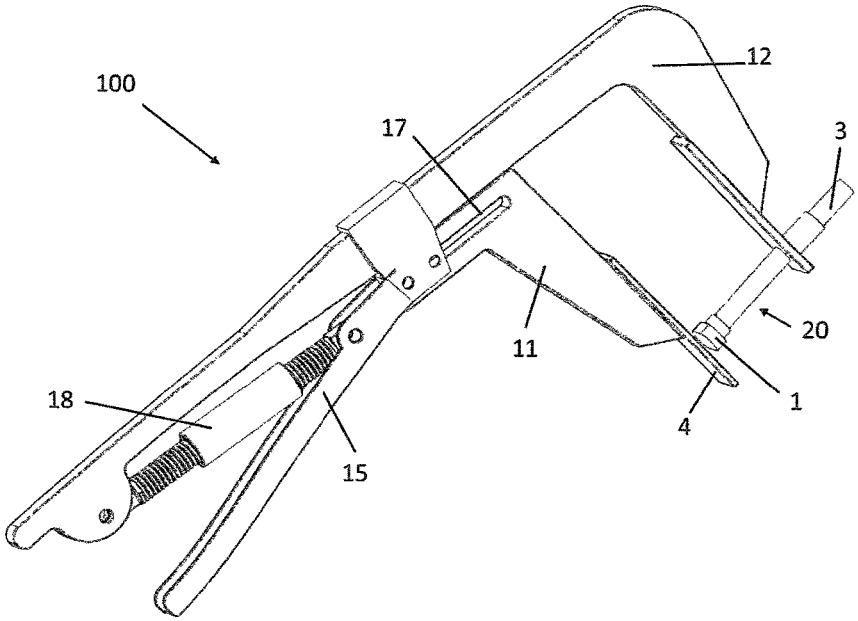
FIG. 3 is an isometric view of an embodiment of a device of the present disclosure for punching an opening into a lightweight metal sheet.

Referring to FIG. 3, a device 100 for punching an opening 8 according to a first exemplary embodiment of the present disclosure is schematically represented. It is in this case provided that this device 100 is operated manually by way of a lever arm 15. Such a device is intended in particular for mobile use. For this purpose, the device 100, formed in the manner of a gripper, comprises a joint system 17, with the aid of which a first gripper jaw 12 and a second gripper jaw 11 can be moved together by actuating the lever arm 15. In particular, the quill 1 with the mounted punch 5 is arranged on the first gripper jaw 12 and a flat matrix 4 for supporting the lightweight metal sheet 2, preferably with a core layer 32 of a thermoplastic material, is arranged on the second gripper jaw 11. In this case, the quill 1 is preferably fastened to a sleeve, and is consequently exchangeable at any time. Arranged within the quill is the heat source 3, which transfers thermal energy to a punch geometry. The moving together of the gripper jaws, i.e. the closing of a gripper opening 20 formed by the gripper jaws, then brings about that relative movement A of the heated-up punch 5 with respect to the lightweight metal sheet 2 placed on the flat matrix 4 that finally leads to the punching of the opening 8, the partial removal of the core layer 32, and the contact between the outer layers 31. These method steps preferably take place in a flowing relative movement A of the two gripper jaws 11, 12 in relation to one another. However, it is also conceivable that the individual method steps take place at individual time intervals, in which the heat of the punch 5 is in each case adapted to the respective method step. For this purpose, a heating capacity of the heat source 3 is appropriately changed, by for example the heat source being exchanged or the current applied to a heating pin being varied.

The flat matrix 4 also serves as a planar abutment, which ensures that a punch imprint is only visible on one side after the punching on the lightweight metal sheet 2. It is also provided that the device 100 has an adjusting screw 18, by way of which the gripper opening 20 can be set. As a result, the gripper opening 20 can be advantageously adapted to the thickness of the lightweight metal sheet 2, which allows the device 100 to be flexibly used.

Figure 4:
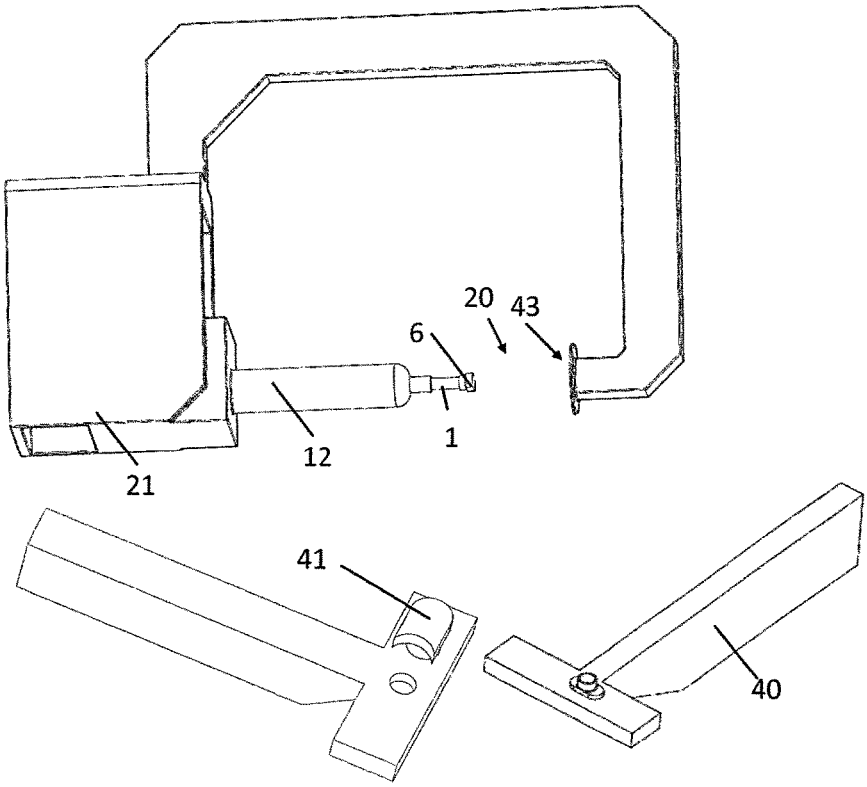
FIG. 4 is an isometric view of an embodiment of a device of the present disclosure for punching an opening into a lightweight metal sheet.

Referring to FIG. 4, a device 100 for punching an opening 8 according to a second exemplary embodiment of the present disclosure is schematically represented. It is in this case provided that this device 100 is operated in an automated manner, for example by way of a robot. Correspondingly, the device 100 represented differs from that from FIG. 3 in that the lever arm 15 with its joint system 17 is replaced here by an automatic, preferably motor-operated, drive 21 for the moving together of the gripper jaws. In particular, it is provided that a punch change can be made with the aid of the robot or robot arm on which the device is mounted. In this case, the device 100—controlled by way of the robot or the robot arm—can be moved to a changing table 40. For a changing mechanism, it is then provided that the first gripper jaw 12 with the quill 1 is moved against a stop 41 of the changing table 40 in such a way that the punch 5 is pushed out by the movement initiated by the robot. Thanks to the conical neck for the quill-punch connection, an easy and complete punch change is then possible when the device 100 is moved to another region of the changing table 40 or to another changing table for receiving another punch 6. For this purpose, the quill 1 is first placed in front of the other punch 6 and subsequently moved in such a way that an interlocking engagement with the quill 1 is produced by way of an axially acting compressive force on the other punch 6. Then the auxiliary means 10 for arresting is used to fix the punch 5 firmly in such a way that it can be used for punching openings 8 into a lightweight metal sheet 2. For this purpose, the device 100 is moved, preferably fully automatically by the robot, until the gripper opening 20 has received a lightweight metal sheet 2 between the gripper jaws. After that, the punching process can then take place.

It is preferably provided that the flat matrix 4 has a suction-extraction opening 43, which allows the extraction of the detached core layer, preferably in the case of pre-punched lightweight metal sheets. For this, it is preferably provided that the suction-extraction opening 43 is arranged in a region of the flat matrix 4 that is opposite the quill 1.

What is claimed is:

1. A device for punching an opening into a lightweight metal sheet having at least two metallic outer layers and at least one non-metallic inner core layer disposed between said metallic outer layers, the device comprising:

a quill having a heat source integrated therewith;

a punch coupled to said quill and configured to be heated by said heat source;

a flat matrix disposed opposite said quill in a first direction of movement, and configured to support said lightweight metal sheet, wherein said flat matrix comprises a continuous opening configured to extract a portion of the lightweight metal sheet displaced during movement of said punch;

a means for moving said punch in the first direction relative to said lightweight metal sheet, said quill, punch, and means for moving said punch forming a punching device;

wherein said punch comprises at least a punching region and a stamping region at least partially surrounding said punching region in a peripheral manner; and wherein the stamping region deforms and brings a portion of the at least two metallic outer layers surrounding the punching region into contact.

2. The device of claim 1, wherein said punch is configured to be exchangeable in said quill.

3. The device of claim 1, wherein said heat source is at least partially disposed within said quill.

4. The device of claim 1, wherein said quill has auxiliary means for arresting said punch on said quill.

5. The device of claim 1, wherein said quill has at least one of a conical or frustoconical shaped neck configured to provide an interlocking connection between said quill and said punch.

6. The device of claim 1, further comprising a gripper having a first gripper jaw onto which said quill is disposed, and a second opposing gripper jaw onto which said flat matrix is disposed.

7. The device of claim 6, wherein said gripper further has a lever arm operatively coupled to at least one of said first or second gripper jaws, and wherein said first gripper jaw is moveable in relation to said second gripper jaw by said lever arm.

8. The device of claim 1, further comprising a robot in operative communication with said punching device, said robot being configured to transfer said punching device to a punch changing table and move said coupled quill and punch into communication with a physical stop that is configured to release said punch from said quill.

9. The device of claim 1, wherein said heat source comprises a heating pin, and wherein a heat output of said heating pin is controllable.

10. The device of claim 1, wherein said punching region extends past said stamping region in the first direction of movement, and wherein an outer diameter of said stamping region is greater than an outer diameter of said punching region.

11. A method of punching an opening into a lightweight metal sheet, comprising:

providing the device for punching of claim 1;

providing a lightweight metal sheet comprising at least two metallic outer layers and at least one non-metallic inner core layer disposed between the metallic outer layers;

disposing said flat matrix opposite said quill in the first direction of movement, and configured to support the lightweight metal sheet;

moving the punch relative to the lightweight metal sheet;

heating at least a portion of the punch by the heating source;

forcing the punch through the lightweight metal sheet so as to cause an opening to be punched there through;

at least partially displacing the nonmetallic core layer of the lightweight metal sheet by thermal energy transferred from the heat source to the punch and to the nonmetallic core layer; and urging the metallic outer layers of the lightweight metal sheet into contact with each other in a region adjacent to the opening.

12. The method of claim 11, wherein said flat matrix comprises a suction-extraction opening configured to extract a portion of the core layer displaced during movement of the device.

13. The method of claim 12, wherein said punch is configured to be exchangeable in said quill.

14. The method of claim 13, further comprising a gripper having a first gripper jaw onto which said quill is disposed, and a second opposing gripper jaw onto which said flat matrix is disposed.

* * * * *